US007985703B2

(12) United States Patent
Freling

(10) Patent No.: US 7,985,703 B2
(45) Date of Patent: Jul. 26, 2011

(54) WEAR-RESISTANT COATING

(75) Inventor: Melvin Freling, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 971 days.

(21) Appl. No.: 11/376,455

(22) Filed: Mar. 15, 2006

(65) Prior Publication Data

US 2007/0216107 A1 Sep. 20, 2007

(51) Int. Cl.
*C04B 35/52* (2006.01)

(52) U.S. Cl. ..... 501/87; 502/177; 501/88; 427/447; 427/450; 427/453

(58) Field of Classification Search ..... 502/117, 502/177; 501/87, 88, 90, 92; 427/446, 450, 427/530, 577, 569
See application file for complete search history.

(56) References Cited

U.S. PATENT DOCUMENTS

| | | | | |
|---|---|---|---|---|
| 3,954,479 | A * | 5/1976 | Jahn | 501/32 |
| 4,728,448 | A | 3/1988 | Sliney | |
| 4,883,639 | A * | 11/1989 | Adlerborn et al. | 419/49 |
| 5,122,182 | A * | 6/1992 | Dorfman et al. | 75/252 |
| 5,536,022 | A | 7/1996 | Sileo et al. | |
| 5,709,936 | A | 1/1998 | Besmann et al. | |
| 5,763,106 | A | 6/1998 | Blanchard et al. | |
| 5,780,116 | A | 7/1998 | Sileo et al. | |
| 6,607,782 | B1 | 8/2003 | Malshe et al. | |
| 2004/0142196 | A1 | 7/2004 | Hajmrle et al. | |

FOREIGN PATENT DOCUMENTS

| | | |
|---|---|---|
| DE | 197 00 835 A1 | 7/1997 |
| JP | 59-029819 | 2/1984 |
| JP | 8-117984 | 5/1996 |

OTHER PUBLICATIONS

Official Search Report of the European Patent Office in foreign Application No. 07250918.5-2122 filed Mar. 6, 2007.

* cited by examiner

*Primary Examiner* — Jessica L Ward
*Assistant Examiner* — Nicholas P D'Aniello
(74) *Attorney, Agent, or Firm* — Kinney & Lange, P.A.

(57) ABSTRACT

A coating suitable for use as a wear-resistant coating for a gas turbine engine component comprises a lubricating material and a hard carbide material.

11 Claims, 1 Drawing Sheet

WEAR-RESISTANT COATING

BACKGROUND

The present invention relates generally to a coating. More particularly, the present invention relates to a coating suitable for use as a wear-resistant coating for a gas turbine engine component.

A wear-resistant coating is often applied to a component that is subject to high friction operating conditions. For example, a gas turbine engine component, such as a seal plate in a rotary seal mechanism, is often subject to high friction and high temperature operating conditions. After some time in service, the friction typically causes the surface of the component that is exposed to the friction to wear. The wear is generally undesirable, but may be especially undesirable and problematic for a sealing mechanism that acts to segregate two or more different compartments of the gas turbine engine. For example, if a sealing component wears (or erodes) and is no longer effective, fluid from one compartment may leak into another compartment. In some portions of a gas turbine engine, failure of the seal mechanism is detrimental to the operation of the gas turbine engine. In those cases, the gas turbine engine must be removed from service and repaired if a part of the seal mechanism wears to the point of seal failure.

A rotary seal mechanism separates two compartments of the gas turbine engine. A rotary seal mechanism typically includes a first component formed of a hard material, such as a carbon seal, that at least in part contacts a surface of a second component formed of a softer material, such as a seal plate, in order to segregate two or more compartments. In some applications, the seal plate rotates as the carbon seal remains fixed, while in other applications, the carbon seal rotates as the seal plate remains fixed. As the seal plate and carbon seal contact one another, the operating temperature and friction levels of both components increase. This may cause the seal plate and/or carbon seal to wear and deteriorate. The relative vibration between the seal plate and the carbon seal during the gas turbine engine operation may also cause frictional degradation and erosion of the seal plate.

It is important to minimize the wear of the seal plate in order to help prevent the rotary seal mechanism from failing. In order to mitigate the wear and deterioration of the seal plate and extend the life of the seal plate, a wear-resistant coating may be applied to the surface of the seal plate that contacts the carbon seal. However, it has been found that many existing wear-resistant coatings crack and spall under the increasingly high engine speeds and pressures. Regardless of the application, it is desirable to increase the life of a wear-resistant coating. Thus, it is also generally desirable to increase the life of wear-resistant coatings that are applied to components other than gas turbine engine components.

BRIEF SUMMARY

The present invention is a wear-resistant coating suitable for a gas turbine engine component, where the coating comprises a lubricating material, such as polytetrafluoroethylene, molybdenum disulfide, boron nitride, cobalt oxide, graphite, and combinations thereof and a hard carbide material, such as tungsten carbide, silicon carbide, chromium carbide, titanium carbide, and combinations thereof.

DETAILED DESCRIPTION

Figure 1:
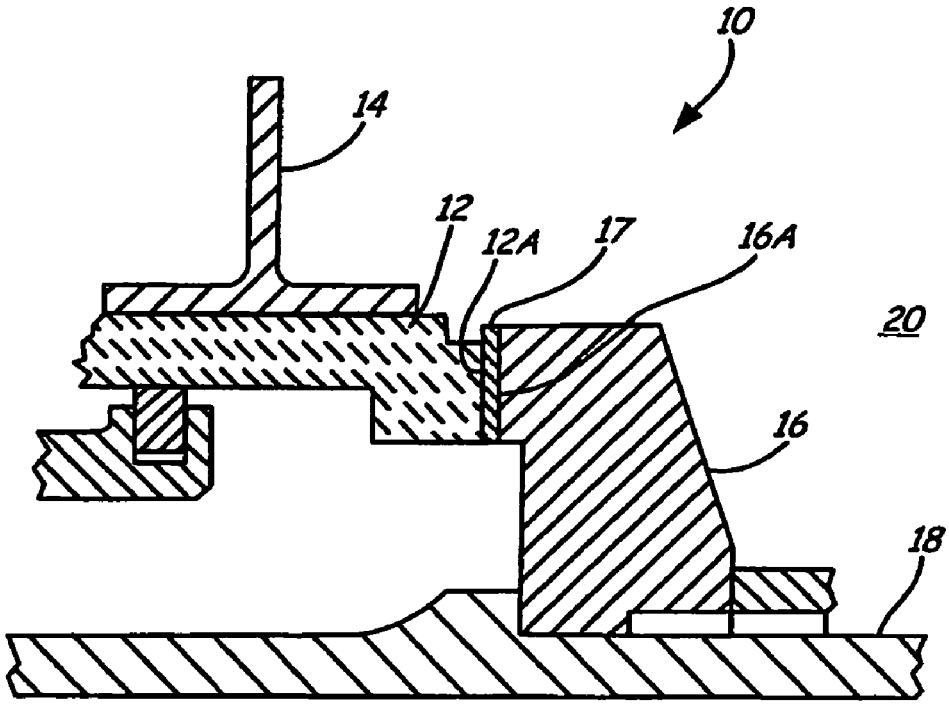
FIG. 1 is a partial cross-sectional view of a rotary seal, which includes a carbon seal and a seal plate.

The present invention is both a coating suitable for use as a wear-resistant coating for a substrate and a method for coating a gas substrate with the inventive coating. A "substrate" is generally any underlying component, including gas turbine engine components. A coating in accordance with the present invention includes about 20 to about 70 percent of a lubricating material and about 30 to about 80 percent of a hard carbide material. The lubricating material includes, but is not limited to, polytetrafluoroethylene, molybdenum disulfide, boron nitride, cobalt oxide, graphite, and combinations thereof. The hard carbide material includes, but is not limited to, tungsten carbide, silicon carbide, nickel chrome/chromium carbide, titanium carbide, and combinations thereof.

The wear-resistant coating of the present invention is particularly suitable for applying onto a surface of a gas turbine engine component that is subject to high friction operating conditions, such as a seal plate of a rotary seal mechanism. However, the coating may be used with any suitable substrate that is subject to wearing conditions, including other gas turbine engine components having a hard-faced mating surface. It is believed that the inventive coating bonds to many substrate materials, including steel and nickel alloys, without the use of a bond coat. However, in embodiments, any suitable bond coat known in the art may be employed, if desired.

As turbine engine speeds and pressures have increased in order to increase engine efficiency, it has been found that many existing wear-resistant coatings that include a hard carbide material, such as nickel chrome/chromium carbide, crack and spall, as well as undergo excessive degradation under the increasingly strenuous operating conditions. Such cracking and spalling is undesirable and may shorten the life of the component on which the wear-resistant coating is applied. At the very least, the early failure of the wear-resistant coating causes the component to be prematurely removed from service in order to repair the wear-resistant coating.

The life of a hard carbide wear-resistant coating may be increased by incorporating a lubricating material into the coating in an amount sufficient enough to decrease the coefficient of friction of the wear-resistant coating. The percentage of the lubricating material varies from about 20 percent to about 70 percent, depending upon the type of hard carbide material in the coating, as well as the particular application of the wear-resistant coating. The presence of a lubricating material in the wear-resistant coating lowers the coefficient of friction of the coating, which allows the coating to wear slower than many existing hard carbide wear-resistant coatings. Also as a result of the lower coefficient of friction of the coating, less frictional heat is generated between the coating and the component the coating is engaged with. This also decreases the rate of wear of the coating.

The coating of the present invention may be applied to a substrate with any suitable method, such as thermal spraying, including plasma spraying and a high-velocity oxy-fuel (HVOF) thermal spray process. In the embodiment discussed below, a HVOF type of thermal spray process is used. In a HVOF thermal spray process, a high velocity gas stream is formed by continuously combusting oxygen and a fuel. A powdered form of the coating is then injected into the high velocity gas stream. The coating is heated to near its melting point, accelerated, and directed at the substrate to be coated. A coating applied with a HVOF process results in a dense coating. This is partially attributable to the overlapping, lenticular particles (or "splats") of coating material that are formed on the substrate. A coating applied with a HVOF process is applied in compression, rather than tension, which also contributes to the increased density and hardness values as compared to other coating application methods.

A coating of the present invention is preferably applied in a thickness of about 0.0508 millimeters (about 2 mils) to about 0.508 millimeters (about 20 mils). In an embodiment of the present invention, the lubricating material and the hard carbide material are blended prior to applying the materials onto a substrate or co-sprayed onto the substrate through two separate powder feeders. The resulting wear-resistant coating is a uniform layer of the blended lubricating and hard carbide material.

FIG. 1 is a partial cross-sectional view of a typical gas turbine engine sealing mechanism 10. Sealing mechanism 10 includes an annular carbon seal ring 12, which is carried by seal carrier 14, and an annular seal plate 16, which is carried by rotating shaft 18. Sealing mechanism 10 is an example of a seal that may be used in a bearing compartment of a gas turbine engine to limit leakage of fluid, such as lubricating oil, from compartment 20 into other parts of the gas turbine engine. Carbon seal ring 12 is formed of a carbonaceous material and seal plate 16 is formed of a metal alloy, such as steel, a nickel alloy, or combinations thereof.

Seal carrier 14 biases face 12A of carbon sealing ring 12 against face 16A of seal plate 16. The biasing is accomplished by any suitable method known in the art, such as by a spring force. Shaft 18 carries seal plate 16, and as shaft 18 rotates, seal plate 16 engages with a surface of carbon seal 12 and frictional heat is generated, causing wear problems at the interface of seal plate 16 and carbon seal 12 (i.e., where face 12A of carbon seal contacts face 16A of seal plate 16).

In order to limit leakage of fluid from compartment 20, it is important to maintain contact between face 12A of carbon seal 12 and face 16A of seal plate 16. Yet, such contact causes seal plate 16 and/or carbon seal 12 to wear. In order to help maintain the functionality of the gas turbine engine, it is important for sealing mechanism 10 to withstand the high-speed conditions and high-temperatures generated as a result of the high-speed conditions. Coating 17, which incorporates a lubricating material and a hard carbide material in accordance with the present invention, is applied to at least a part of face 16A of seal plate 16 that contacts face 12A of carbon seal 12 (coating 17 is not drawn to scale in FIG. 1). Coating 17 helps prevent erosion and deterioration of face 16A of seal plate 16 that results from contacting face 12A of carbon seal 12 (e.g., from friction), which helps prevent seal mechanism 10 from failing. Carbon seal 12 is formed of a harder and more wear-resistant material than seal plate 16, and the rate of wear is slower for carbon seal 12 than it is for seal plate 16.

In the embodiment of FIG. 1, coating 17 is applied with a HVOF thermal spray process in a thickness of about 0.0508 millimeters (about 2 mils) to about 0.508 millimeters (about 20 mils).

In embodiments, the carbon seal 12 may be coated with coating 17, either in addition to or instead of coating the seal plate 16 with coating 17.

Sealing mechanism 10 is shown as a general example of a component (or substrate) that includes surfaces subject to wearing conditions. A coating in accordance with the present invention is also suitable for applying to components other than gas turbine engine components that are exposed to wearing conditions, such as the mating face of flanges.

The terminology used herein is for the purpose of description, not limitation. Specific structural and functional details disclosed herein are not to be interpreted as limiting, but merely as bases for teaching one skilled in the art to variously employ the present invention. Although the present invention has been described with reference to preferred embodiments, workers skilled in the art will recognize that changes may be made in form and detail without departing from the spirit and scope of the invention.

The invention claimed is:

1. A coating consisting essentially of:

about 30 to about 80 weight percent of a hard carbide material; and about 20 to about 70 weight percent of lubricating material incorporated with the hard carbide material, wherein the lubricating material includes cobalt oxide, wherein the coating defines overlapping lenticular particles.

2. The coating of claim 1, wherein the hard carbide material is selected from a group consisting of nickel chrome and chromium carbide, tungsten carbide, silicon carbide, titanium carbide, and combinations thereof.

3. The coating of claim 1, wherein the hard carbide material and lubricating material are co-sprayed onto a substrate.

4. The coating of claim 3, wherein the substrate is a gas turbine engine component.

5. The coating of claim 3, wherein the hard carbide material and lubricating material are co-sprayed onto the substrate with a thermal spraying process.

6. The coating of claim 1, wherein the hard carbide material and lubricating material are blended together prior to applying the coating onto a substrate.

7. The coating of claim 6, wherein the substrate is a gas turbine engine component.

8. The coating of claim 6, wherein the coating is applied onto the substrate with a thermal spraying process to produce a coating with density and hardness characteristics consistent with those produced with high velocity oxygen-fuel spraying techniques.

9. The coating of claim 1, wherein the hard carbide material and the lubricating material define a matrix of compressed particles.

10. A coating consisting essentially of:

about 30 to about 80 weight percent of a hard carbide material, wherein the hard carbide material is selected from a group consisting of nickel chrome and chromium carbide, tungsten carbide, titanium carbide, and combinations thereof; and about 20 to about 70 weight percent of lubricating material incorporated with the hard carbide material, wherein the lubricating material is selected from a group consisting of polytetrafluoroethylene, boron nitride, cobalt oxide, and combinations thereof, wherein the coating defines overlapping lenticular particles.

11. The coating of claim 10, wherein the overlapping lenticular particles are in compression relative to each other.

* * * * *